US011629466B2

(12) United States Patent
Diehl et al.

(10) Patent No.: US 11,629,466 B2
(45) **Date of Patent: *Apr. 18, 2023**

(54) ROAD SAFETY RAIL SYSTEMS AND PARTS AND FITTINGS THEREFOR

(71) Applicant: Valmont Highway International Pty Limited, Sydney (AU)

(72) Inventors: Andrew Karl Diehl, Christchurch (NZ); Andrew Michael Sarratt, Christchurch (NZ); Kenneth Lloyd Readman, Christchurch (NZ); Alexander Peter Hannibal Newman, Christchurch (NZ); Andrew John Beale, Christchurch (NZ); Christopher James Allington, Christchurch (NZ); Leigh Robert Brown, Christchurch (NZ)

(73) Assignee: Valmont Highway International Pty Limited, Sydney (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/812,535

(22) Filed: Jul. 14, 2022

(65) Prior Publication Data

US 2022/0349136 A1 Nov. 3, 2022

Related U.S. Application Data

(63) Continuation of application No. 16/481,370, filed as application No. PCT/IB2018/050414 on Jan. 24, 2018, now Pat. No. 11,391,006.

(30) Foreign Application Priority Data

Jan. 23, 2018 (AU) ..... 2018900209

(51) Int. Cl.
*E01F 15/14* (2006.01)
*E01F 15/04* (2006.01)

(52) U.S. Cl.
CPC ..... *E01F 15/146* (2013.01); *E01F 15/0407* (2013.01); *E01F 15/143* (2013.01)

(58) Field of Classification Search
CPC ... E01F 15/04; E01F 15/0407; E01F 15/0423; E01F 15/143; E01F 15/145; E01F 15/146
See application file for complete search history.

(56) References Cited

U.S. PATENT DOCUMENTS 5,044,609 A * 9/1991 Cicinnati ..... E01F 15/0415 256/19
5,931,448 A 8/1999 Sicking et al.
(Continued)

FOREIGN PATENT DOCUMENTS

CN 105780690 A 7/2016
CN 106812088 A 6/2017
(Continued)

OTHER PUBLICATIONS

International Search Report for PCT Application No. PCT/IB2018/050414, dated Apr. 11, 2018 in 7 pages.
(Continued)

*Primary Examiner* — Jonathan P Masinick
(74) *Attorney, Agent, or Firm* — Knobbe, Martens, Olson & Bear, LLP

(57) ABSTRACT

A moving energy absorbing component includes an impact head including a base and upright projection. The base includes an axial orifice extending from a downstream entry point to an upstream exit point, through which an upstream terminus of an FTE rail is passed before the FTE rail is directly or indirectly connected to a releasable connection point coupled to a ground anchor. The impact head is
(Continued)

connected via at least one beam to a post detacher element located downstream of the impact head a pre-determined distance therefrom.

3 Claims, 9 Drawing Sheets

(56) References Cited

U.S. PATENT DOCUMENTS

| | | | | |
|---|---|---|---|---|
| 6,554,256 | B2 | 4/2003 | Ochoa | |
| 6,719,483 | B1 | 4/2004 | Welandsson | |
| 7,185,882 | B2 | 3/2007 | Buth et al. | |
| 7,396,184 | B2 * | 7/2008 | La Turner | E01F 15/146 404/9 |
| 7,883,075 | B2 | 2/2011 | Abu-Odeh et al. | |
| 9,145,943 | B2 | 9/2015 | Sicking | |
| 9,714,493 | B1 | 7/2017 | Dyke et al. | |
| 10,036,132 | B2 | 7/2018 | Sicking | |
| 10,364,538 | B2 | 7/2019 | Dyke et al. | |
| 10,851,503 | B2 | 12/2020 | Alberson et al. | |
| 2011/0057160 | A1 | 3/2011 | Abu-Odeh et al. | |
| 2015/0001454 | A1 | 1/2015 | James | |

FOREIGN PATENT DOCUMENTS

| | | | |
|---|---|---|---|
| CN | 108643083 | A | 10/2018 |
| CN | 109653138 | A | 4/2019 |

OTHER PUBLICATIONS

Written Opinion for PCT Application No. PCT/IB2018/050414, dated Apr. 11, 2018 in 9 pages.

* cited by examiner

ROAD SAFETY RAIL SYSTEMS AND PARTS AND FITTINGS THEREFOR

CROSS-REFERENCE TO RELATED APPLICATIONS

This application is a continuation Application of U.S. application Ser. No. 16/481,370, filed on Jul. 26, 2019 as the U.S. National Phase under 35. U.S.C. § 371 of International Application PCT/IB2018/050414, filed Jan. 24, 2018, which claims priority to Australian Patent Application No. 2018900209, filed Jan. 23, 2018. The disclosures of the above-described applications are hereby incorporated by reference in their entirety.

TECHNICAL FIELD

The present invention relates to improvements in and relating to road safety rail systems and parts and fittings therefor. In particular, the present invention relates to an end terminal system for a road safety rail system.

BACKGROUND ART

The construction of terminal ends for safety rail systems such as for example guardrail systems or road barriers including W-beams and Thrie-beams are well known. However, known terminal ends suffer from performance limitations and short comings which can include:

- Complicated construction requiring modification (e.g. removing material) from a large number of rails over a long distance, which is labour intensive, time consuming and expensive;
- Potential instability of the constricting head;
- Difficulties transitioning the rail from an above ground height down to ground level;
- Requiring tensioned cables;
- Complicated head designs to deform the rail in one or more dimensions;
- Creating hazards for vehicles which detract from any energy absorbing capability of the terminal end including but not limited to creating a potential ramp for an impacting vehicle;
- The potential for the rail to buckle and fail to adequately and/or safely absorb energy.

The purpose of a guardrail system is to safely keep errant vehicles away from hazards. As such it is important that the guardrail does not form a hazard in its own right. This is critical when impacting into the end of the rail system as the rail can form a direct hazard. To deal with this potential, the end of the rail is required to move out of the way of an impacting vehicle.

It is an object of the present invention to provide an improved or alternative terminal end for a safety rail system and/or parts or fittings therefor, or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprises", or variations thereof such as "comprise" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

DEFINITIONS

The term 'direct on impact' as used herein refers to an impact which is direct on the upright of the impact head and in-line with the length of the rail system (i.e. an impact at 0 degrees to the impact head/rail system).

The term 'head on impact' as used herein refers to an impact which is at or near direct on the upright of the impact head at an angle of substantially between 0 degrees (i.e. dead center) to 25 degrees. The term head on impact therefore includes a direct on impact.

The term 'lateral impact' as used herein refers to a side on impact at or near the impact head at angle greater than 25 degrees to dead center of the impact head.

The term 'reverse impact'; as used herein refers to an impact on the impact head in the wrong (i.e.

opposite direction) to a head on impact.

The portion of the rails, or portions of the rail system, which are closest to the moving energy absorbing component and/or associated releasable connection are termed 'upstream' and conversely the portions of the rail system which are further away from the connection system are termed 'downstream'. Thus, every rail in the system has an upstream end and a downstream end relative to the moving energy absorbing component being discussed.

The term "plastic deformation" as used herein refers to a permanent change in shape (i.e. deformation) of a rail under the action of a sustained force.

DISCLOSURE OF THE INVENTION

The present invention primarily has application to the terminal ends of road safety rail systems. However, this should not be seen as limiting, as the principles of the present invention may equally apply to the terminal ends of other road barriers including but not limited to:

- Concrete barriers;
- Cable barriers.

According to one aspect of the present invention there is provided a road safety rail system comprising at least one continuous rail, or a plurality of sequentially connected system rails, forming a main body of a barrier, which are supported above ground by one or more ground engaging posts, wherein the system also comprises a terminal end section (TES) having an upstream end and a downstream end, the TES including:

- a stationary component comprising one or more standard terminal end (STE)-rails at the downstream end connected to at least one formed terminal end (FTE)-rail located at the upstream end of the TES,
- the STE rails being supported at a set horizontal axis height above ground level by a plurality of posts;
- wherein the at least one FTE-rail(s)-include(s) a twist from a primarily vertical orientation to a primarily horizontal orientation;

wherein the at least one FTE rail(s) bends down from a set horizontal axis height Y above ground level to a horizontal axis height being at, or near ground level;

a moving energy absorbing component comprising an impact head including a base and upright projection, the base comprising an axial orifice extending from a downstream entry point to an upstream exit point, through which an upstream terminus of an FTE rail is passed before the FTE rail is directly or indirectly connected to a releasable connection point coupled to a ground anchor;

wherein the impact head is connected via at least one beam to a post detacher element located downstream of said impact head a pre-determined distance therefrom.

Preferably, one or more of the posts supporting the STE rails may be adapted to fold. Preferably, a top portion of the upright on impact head may be connected via at least one beam to the post detacher.

Preferably, the twist in the FTE rail(s) occurs whilst maintaining a horizontal axis substantially at, or near, the same set height above ground level.

According to a second aspect of the present invention there is provided a road safety rail system substantially as described above wherein the moving energy absorbing component further includes a brace element which diagonally extends at a predetermined non-orthogonal angle from the base of the impact head from a point adjacent the top of the entry point of the axial orifice to the at least one beam.

According to a third aspect of the present invention there is provided a road safety rail system substantially as described above wherein there is provided two curved beams which connect the upright to the post detacher element the curved beams being positioned on either side of the impact and post detacher element.

According to a fourth aspect of the present invention there is provided a road safety rail system substantially as described above wherein the impact head and associated beam(s) and post detacher element travel together as a unit along the rails of the system when a vehicle has a head on impact with the upstand of the impact head.

According to a fifth aspect of the present invention there is provide a road safety rail system substantially as described above wherein following a head on impact from an errant vehicle the travel of the impact head along the rails, causes the STE rails to twist and bend in substantial conformance with the twist and bends of the FTE rails of the TES.

According to a sixth aspect there is provided a road safety rail system substantially as described above wherein a bracing element is attached to the impact head to stabilise the curved beam(s) and assist with guiding the FTE rail(s) and STE rails into the axial orifice of the impact head.

According to a seventh aspect there is provided a road safety barrier system substantially as described above wherein the axial orifice includes a portion thereof with a profile which decreases in size from the rail entry point.

According to an eighth aspect there is provided an impact head including a base and upright projection, the base comprising at least one axial orifice extending from a downstream end to an upstream end, through which, in use, a terminus of a distal FTE rail is passed before being connected to a releasable connection point.

According to a ninth aspect there is provided an impact head substantially as described above wherein the base has a convex curved bottom surface when viewed side on.

According to a $10^{th}$ aspect there is provided an impact head substantially as described above wherein the height of the upstand above ground level, when the base is resting on the ground, is substantially 650 mm-1000 mm.

According to an $11^{th}$ aspect there is provided an impact head substantially as described above wherein the axial orifice is downwardly curved from the downstream entry point to upstream exit point.

According to an $12^{th}$ aspect there is provided an impact head substantially as described above wherein the impact head includes an axial orifice including a taper therein which decreases the size of the axial orifice relative to that of the rail entry point.

According to a $13^{th}$ aspect there is provided an impact head substantially as described above wherein the axial orifice of the impact head has a cross-sectional profile which is tapered in at least one plane.

According to a $14^{th}$ aspect there is provided an impact head substantially as described above wherein the axial orifice of the impact head has a cross-sectional profile which is tapered in the horizontal or vertical plane.

According to a $15^{th}$ aspect there is provided an impact head substantially as described above wherein the axial orifice has a cross-sectional profile which is tapered in both the horizontal and vertical planes.

According to a $16^{th}$ aspect of the present invention there is provided a releasable connection point (RCP) between an upstream FTE rail and a ground anchor wherein the RCP includes an anchor hitch connected to an anchor protrusion on the ground anchor; wherein the anchor hitch includes a recess which has no side walls into which the anchor protrusion can be received and retained whilst the rails remain under tension and from which the anchor protrusion can be upon a lateral impact and/or reverse impact from a vehicle.

According to a $17^{th}$ aspect of the present invention there is provided a releasable connection point (RCP) between the distal rail element and a ground anchor, the RCP including:

A ground anchor post, wherein the top of the post includes an anchor plate which creates a lip on the top of the anchor post;

A ground anchor hitch, which includes:

a body portion;

a bearing edge extending down from the body portion at an upstream end thereof;

a catch plate connected to the distal end of the bearing edge and forming a flange thereon extending in downstream direction, the region between the flange, bearing edge and the body portion forming a catch-zone;

Wherein, in use, the lip on the anchor post is received into the catch-zone to create a releasable connection;

Such that the releasable connection is held in place by a force in a first direction and released by either:

a force in a second direction opposite to said first force; and/or a lateral force relative to the direction of said first force.

Preferably the downstream edge of the anchor plate forming the lip has a concave curve therein; and the bearing edge and catch plate both include a convex curve thereon that abuts the concave curve on the lip on the anchor plate.

According to an $18^{th}$ aspect there is provided a retarding section on one or more rails of at a downstream end of the terminal end section TES wherein the retarding section includes at least one projection extending, or series of projections positioned, along the length of the non-trafficable side of a rail, wherein the portion of the downstream rail where the projection(s) terminate includes a stop thereon.

According to a 19$^{th}$ aspect there is provided a moving energy absorbing component comprising:

at least one FTE rail, wherein the at least one FTE-rail(s) include(s) a twist from a primarily vertical orientation to a primarily horizontal orientation, whilst maintaining a horizontal axis at the same set height above ground level; and wherein the at least one FTE rail(s) bends down from a set horizontal axis height above ground level Y to a horizontal axis height being at, or near ground level;

an impact head including a base and upright projection, the base comprising an axial orifice extending from a downstream entry point to an upstream exit point, through which an upstream terminus of an FTE rail is passed;

wherein a top portion of the upright on the impact head is connected via at least one beam to a post detacher element located downstream of said impact head a pre-determined distance therefrom.

According to a 20$^{th}$ aspect there is provided a moving energy absorbing component wherein the moving energy absorbing component further includes a brace element which diagonally extends at a predetermined non-orthogonal angle from the impact head to a point adjacent the top of the entry point of the axial orifice to the at least one beam.

Preferably, the brace may extend from the base of the impact head.

According to a 21$^{st}$ aspect of the present invention there is provided a formed terminal end rail section comprising at least one formed terminal end (FTE)-rail the FTE rail(s) including a twist from a primarily vertical orientation to a primarily horizontal orientation, along a longitudinal mid axis; wherein the FTE rail(s) bend(s) down away from said longitudinal mid axis to a lower axis which is substantially parallel thereto.

According to a 22$^{nd}$ aspect of the present invention there is provided a post which includes a structural deformation thereon which weakens the post in one axial direction and which causes the post to fold at or near the point of the structural deformation, when subjected to an impact force of sufficient magnitude along said axial direction; said structural deformation being located on the post at a position substantially at or near ground level when the post is in use.

Preferably, said deformation on the post weakens the cross-sectional profile of the post.

BRIEF DESCRIPTION OF THE DRAWINGS

Further aspects of the present invention will become apparent from the ensuing description which is given by way of example only and with reference to the accompanying drawings in which.

BEST MODES FOR CARRYING OUT THE INVENTION

Figure 1:
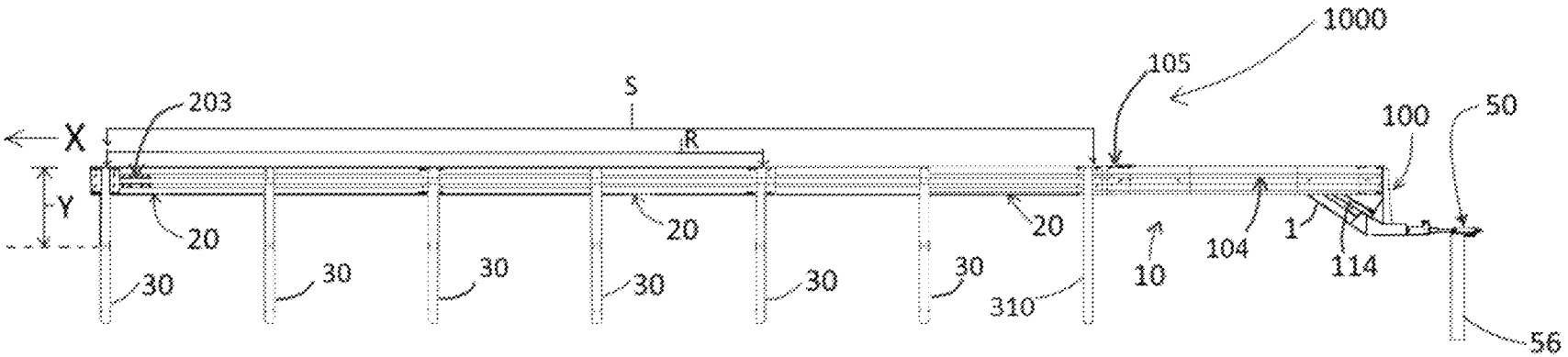
FIG. 1 shows a side view of a terminal end section (TES) of a road safety rail system on the non-trafficable side thereof in accordance with a preferred embodiment of the present invention.

With respect to FIGS. 1-18 there is shown the terminal end section (TES) 1000 of a road safety rail system, the rest of the rail system extending in direction X, is not shown as it consists of standard posts and sequentially connected rails in the form of W-beams (system rails) as is well known in the art. Unless otherwise stated the posts and rails of the TES 1000 are connected by bolts as is standard industry practice.

Stationary Component—see in particular FIGS. 1-4, and 11

The TES 1000 has a stationary component indicated by double headed arrow S having:

a plurality of sequentially connected standard terminal end (STE)-rails 20 in the form of W-beams; and sequentially connected formed terminal end (FTE)-rails 1,2 also in the form of W-beams.

The STE rails 20 are supported above the ground at a set height Y, by a plurality of terminal posts in the form of I-beam posts 90, which provide a rail height of substantially 780 mm.

In the embodiment shown in the Figures (and see in particular FIG. 11) the terminal posts 30 are in the form of I-Beam posts which have a weakened cross-sectional profile formed via dimples 31 (depressed) on the edges of upstream and downstream flange 32,33 inwards towards web 34 as shown by arrow 31 towards the web of the I-beam. The dimples are positioned at or near ground level, when the post is installed, this dimpling helps cause the post to fold (i.e. bend rather than tear) upon receiving an impact force in either direction indicated by double headed arrow Z. The posts 30 have curved top edges 35 which helps remove the possibility that any sharp corners on the top of the post will cut the underside of a vehicle passing over the post or diminishes sharp edges of the post creating a hazard to first responders to an accident, or to the crew repairing the road safety rail system after a crash.

It is to be noted the most upstream post of the terminal end of the road safety system is a standard I-beam post 310 (i.e. a non-weakened post).

The most upstream STE rail 20*u* is connected at the upstream end thereof to FTE rail 2 which in turn is connected to FTE rail 1.

Figure 3:
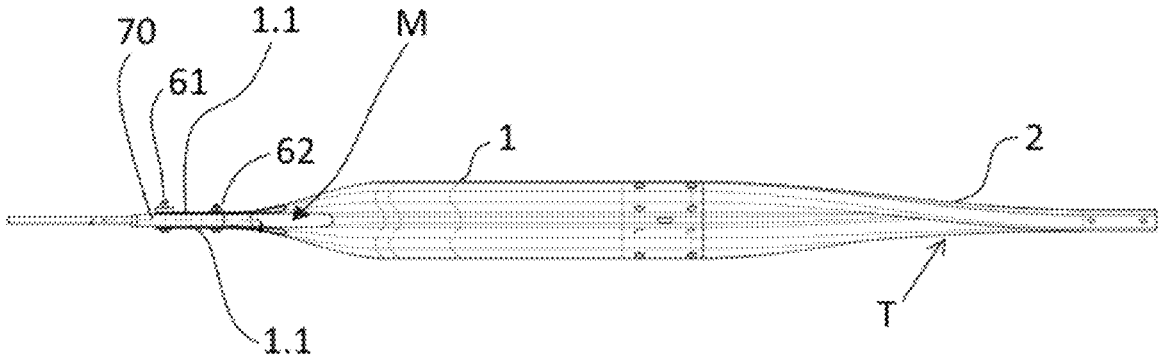
FIG. 3 shows a plan view of a formed terminal end rail section depicting the FTE rails as also shown in FIG. 2.
Figure 4:
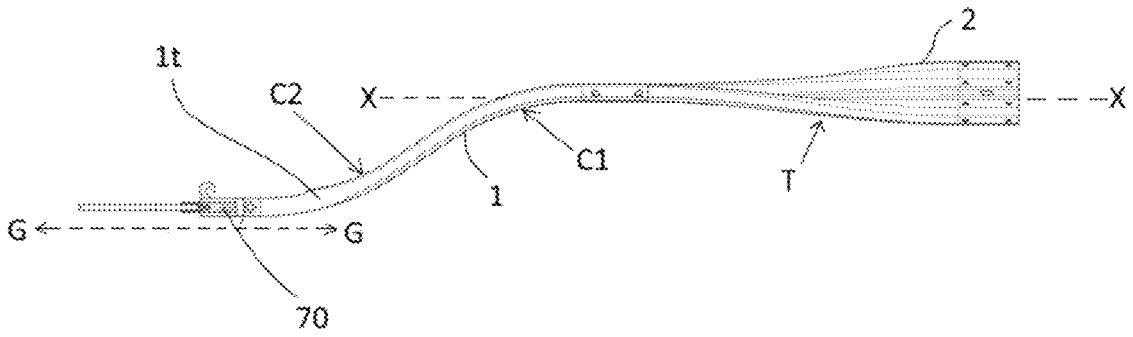
FIG. 4 shows a side view of the formed terminal end rail section/FTE rails shown in FIG. 3.

Formed terminal end rail section/FTE Rails—see in particular FIGS. 3 and 4

As can be seen FTE rail 2 has a twist T where rail 2 transitions from a primarily vertical orientation to a primarily horizontal orientation, whilst maintaining a horizontal axis X at substantially the same set height above ground level. The twist T involving an anticlockwise 180-degree rotation of FTE rail 2 around a central axis.

FTE rail 1 is the terminal rail in the TES and has a horizontal orientation enabling connection to FTE rail 2. As can be seen the first FTE rail 1 bends down via first and second curves C1 and C2 from a set horizontal axis height above ground level to a horizontal axis height being at, or near ground level; indicated by dotted line G-G.

The upstream terminus 1*t* of FTE rail 1 passes through an axial orifice 103 in impact head 100 before the FTE rail 1 is indirectly connected to a releasable connection point 50. The indirect connection is achieved via an anchor block 70 which is connected to an anchor hitch 51 via connector rod 52. The terminus 1*t* of FTE rail 1 has had the middle section as at M of the W-beam removed therefrom to leave to two opposed vertical walls 1.1 which have a plurality of aligned apertures therein (of which only two can be seen) which enables the terminus 1*t* of FTE rail 1 to be tensioned when being bolted 61, 62 to the anchor block 70.

Moving Energy Component—see in particular FIG. 2 and FIGS. 11-17

The TES 1000 also has a moving energy absorbing component 10 at the upstream end thereof. The moving energy component 10 has an impact head 100 which has a base 101 and an upstand 102. The height of the upstand 102 is substantially 780 mm. The upstand 102 has two W-beam stubs 1030 extending from the downstream side thereof to which two curved W-beams 104 are bolted at one end thereof. The other ends of the curved W-beams 104 are connected to either side of a post detacher element 105. The post detacher element 105 sits on the non-trafficable side of the rails where FTE rail 2 is connected to the upstream STE rail 20u. As can be seen the post detacher element 105 has upper and lower brace plates 106,107 which extend laterally from a head portion 108 and connect to the curved rail 104 on the trafficable side of the barrier. The post detacher head portion 108 being located on the non-trafficable side of the barrier. The post detacher 108 is shown in more detail in FIGS. 15 and 16 where it can be seen the head portion 108 has apertures 109 which allow it to be bolted to the curved rail 104 on the non-trafficable side. The head portion 108 also has apertures 110 and 111 which enable the brace plates 106,107 to be bolted thereto. The upper and lower brace plates 106,107 are mirror images of one another as indicated by mirror line M-M in FIG. 15. The brace plates 106,107 have apertures 112 and 113 which allow the brace plate to be bolted to the head portion 108 and a curved rail 104. The head portion 108 also uses apertures 109 to connect to the FTE rail 2 via shear bolts 114.

Figure 2:
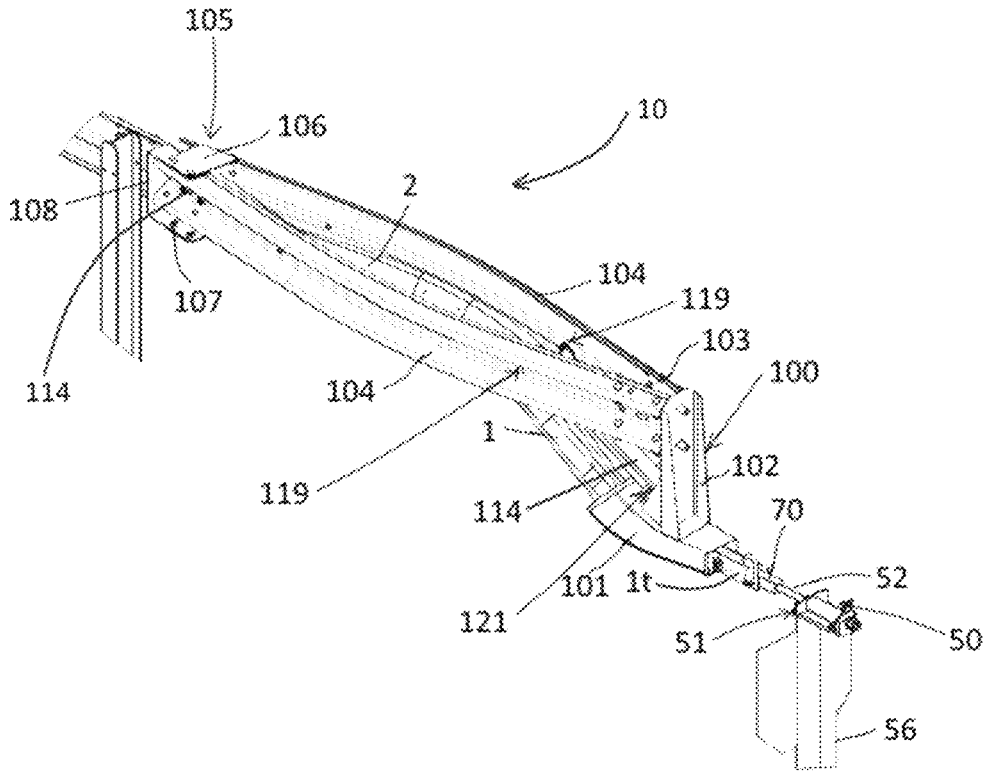
FIG. 2 shows a close up perspective view of the moving component, FTE rails and releasable connection point of the (TES) of the road safety rail system shown in FIG. 1.
Figure 17:
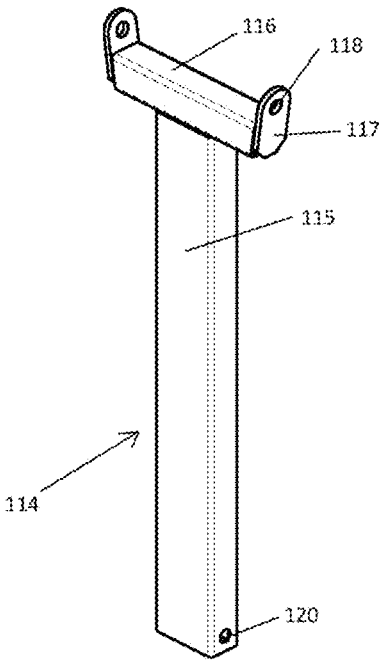
FIG. 17 shows a close up perspective view of a brace element as shown in FIGS. 1 and 2.

The impact head 100 also has a diagonal brace element 114 shown in FIGS. 1,2 and 17. As can be seen in FIG. 1 the angle of the brace with respect to the horizontal is substantially similar to the angle at which the FTE rail 1 is bent to transition from rail height down to the axial orifice 103 of the impact head 100.

The brace element 114 has a post section 115 with a cross bar 116 at the top thereof. The cross bar 116 has flanges 117 on either end which include apertures 118 therein for bolting to the curved beams 104 as shown by arrow 119. The bottom end of the post section 115 has an aperture 120 therethrough which enables the brace element 114 to be bolted to the impact head 100 as shown by arrow 121.

Releasable Connection Point—see in particular FIG. 5-10

The anchor block 70 is connected to a ground anchor hitch 51 by a connector rod 52 which is threaded at both ends, and has one end threadably engaged with a threaded aperture 53 in the anchor block 70. The connector rod 52 has the other end passing through the ground anchor hitch 51 via aperture 54 before being secured thereto by a pair of bolts 55. The ground anchor hitch 51 has a lipped connection (seen most clearly in FIG. 6) to the anchor plate 57 on the top of a ground anchor post 56.

As can be seen ground anchor post 56, has an anchor protrusion in the form of an anchor plate 57 on the top of the post which creates a lip 58 on the top of the anchor post which engages with the ground anchor hitch 51. Ground anchor post 56 also has a soil plate 5 thereon which helps prevent movement of the post through the soil.

The ground anchor hitch 51 (seen most clearly in FIGS. 5-9) has a body portion 59 having a bearing edge 60 extending down from the body portion 59 at an upstream end thereof; a catch plate 61 is connected to the distal end of the bearing edge 60 and forming a flange 62 thereon extending in downstream direction. The region between the flange catch plate 61, bearing edge and the body portion forming a recess which functions as a catch-zone 63.

Wherein, in use, the lip 58 on the anchor post 56 is received into the catch-zone 63 to create a releasable connection. As can also be seen the anchor hitch 51 has an end plate 65 at a downstream end of the body portion 59 and a cap 64 at an upstream end of the anchor hitch.

The end plate 65 of the anchor hitch 51 projects transversely out on either side of the anchor hitch a distance which is greater than the width of the axial orifice so as to prevent the anchor hitch from being pulled through the impact head.

The edge of the anchor plate 57 forming the lip 58 has a concave curve 66 (see FIG. 9) therein and on the anchor hitch 51 the bearing edge 60 and catch plate 61 both include a convex curve shown generally by arrows 67, 68 thereon (see FIG. 10) that in use will abut the lip 58 and concave curve 66 on the anchor plate 57.

The lipped connection between the anchor hitch and the anchor plate (seen most clearly in FIG. 6) together with the respective convex curves 67,68 on the anchor hitch and concave curve 66 on the anchor plate where they abut each other in use, enable the releasable connection to be held in place by a force in a first direction see arrow F1 and released by either:

- a force in a second direction see arrow F2 opposite to said first force; and/or
- a lateral force relative to the direction of said first force F1.

Figure 5:
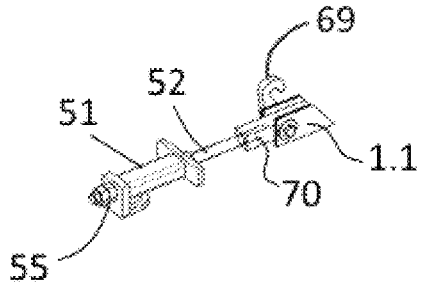
FIG. 5 shows a close up perspective view of the releasable connection point shown in FIGS. 1 and 2.
Figure 6:
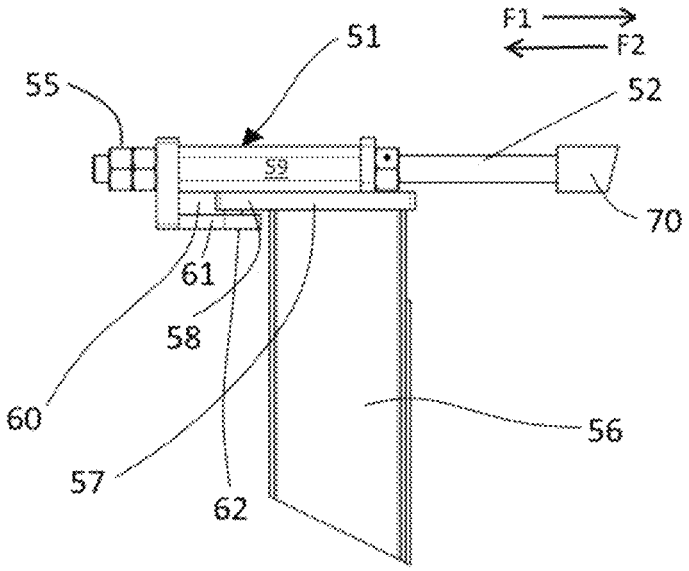
FIG. 6 shows a side view of the releasable connection point shown in FIG. 5.
Figure 7:
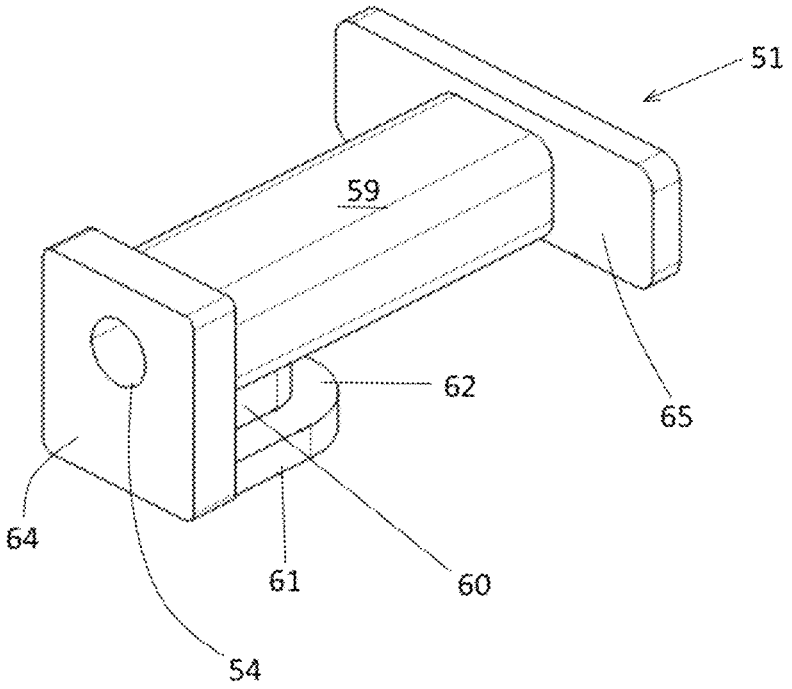
FIG. 7 shows a close up perspective view of the ground anchor hitch of the releasable connection point shown in FIG. 5.
Figure 8:
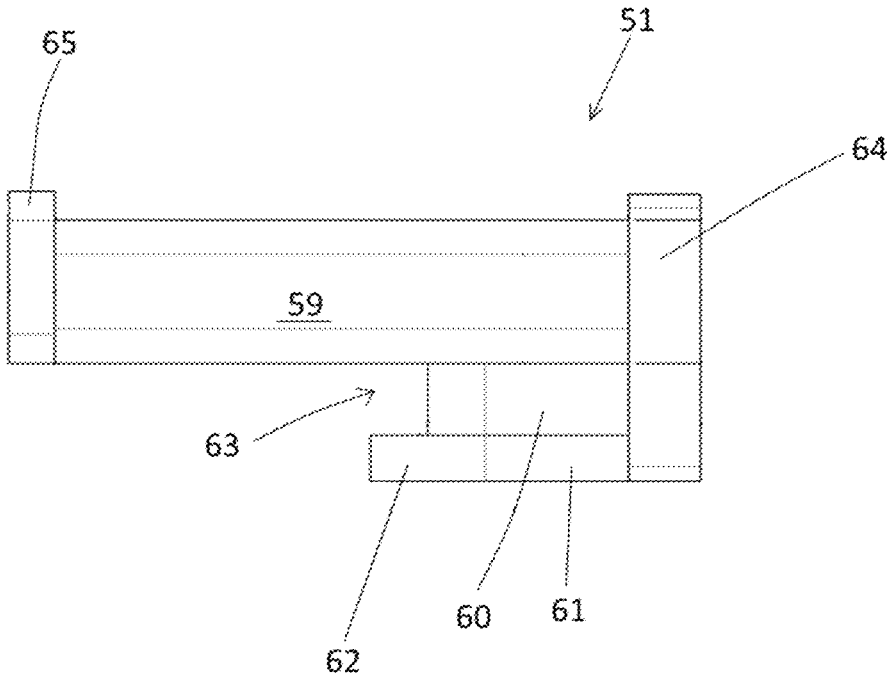
FIG. 8 shows a side view of the ground anchor hitch shown in FIG. 6.
Figure 9:
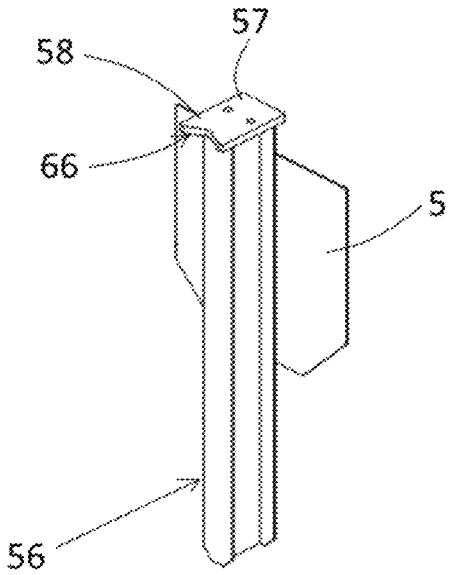
FIG. 9 shows a perspective view of the ground anchor post of the releasable connection shown in FIGS. 1 and 2.
Figure 10:
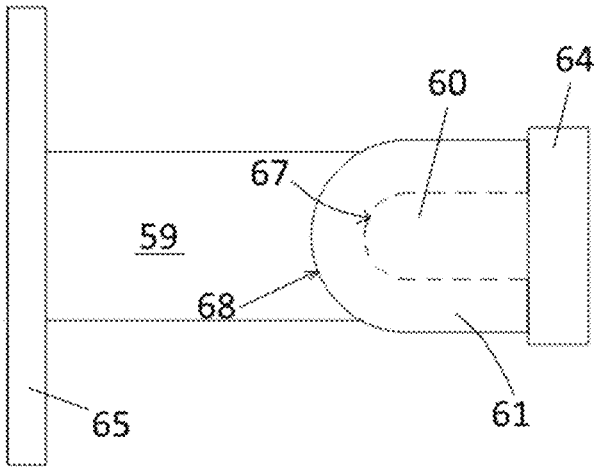
FIG. 10 shows a bottom plan view of the ground anchor hitch shown in FIGS. 6-8.
Figure 11:
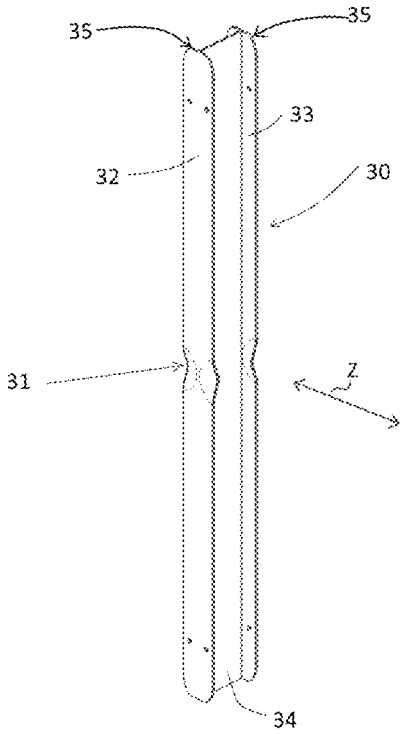
FIG. 11 shows a close up perspective view of the weakened post shown in FIGS. 1 and 2.
Figure 12:
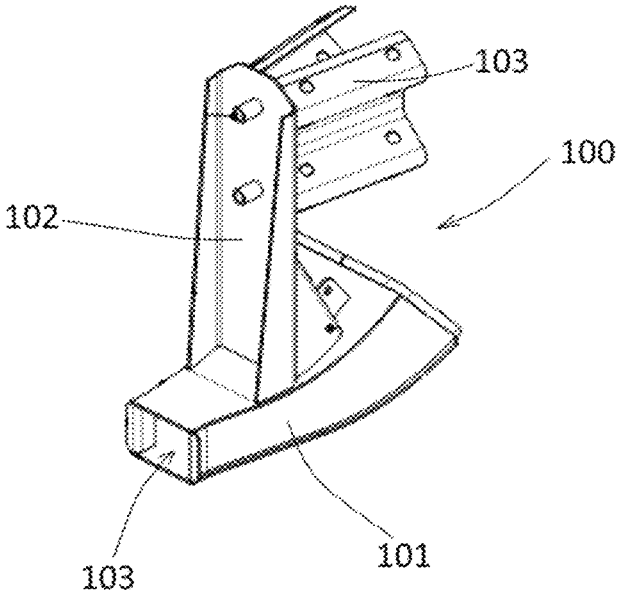
FIG. 12 shows a perspective upstream view of the impact head shown in FIGS. 1 and 2.
Figure 13:
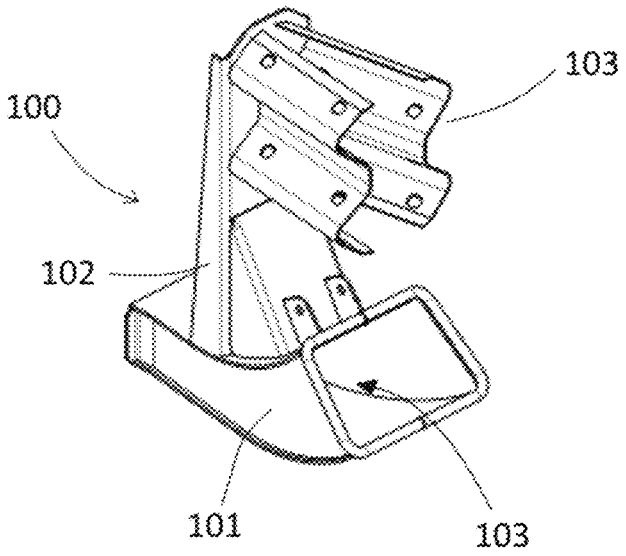
FIG. 13 shows a perspective downstream view of the impact head shown in FIG. 10.
Figure 14:
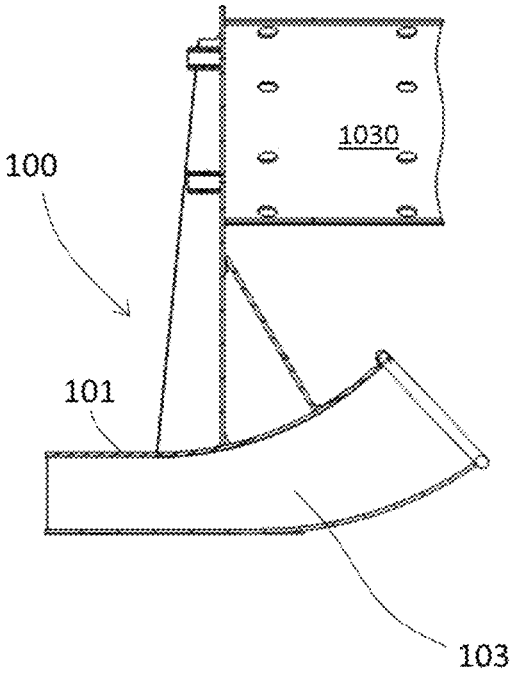
FIG. 14 shows a side view of the impact head shown in FIGS. 10 and 11.
Figure 15:
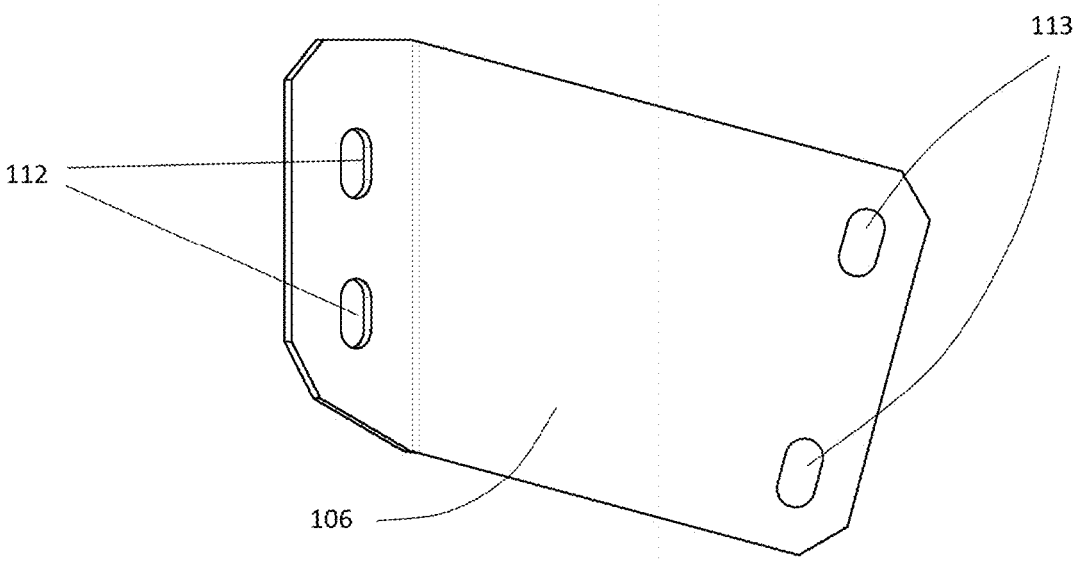
FIG. 15 shows a close up perspective view head portion of a post detacher element as shown in FIGS. 1 and 2.
Figure 16:
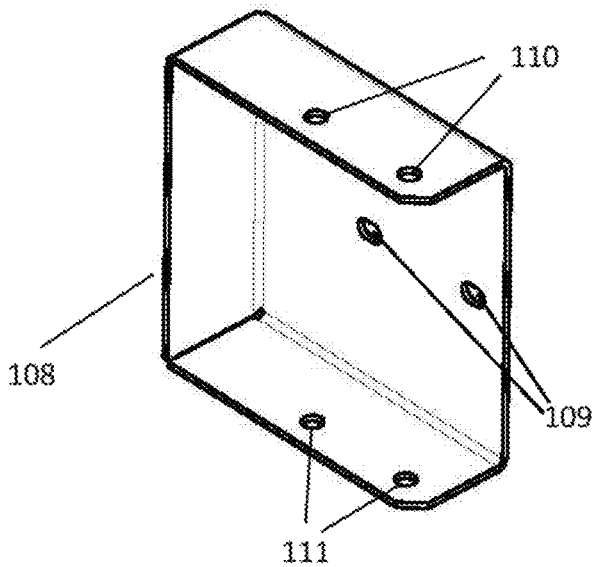
FIG. 16 shows a close up perspective view of a brace plate of post detacher element as shown in FIGS. 1 and 2.

In FIGS. 1, 2 and 5 it can be seen that there is a hook 69 attached to the terminus 1*t* of FTE rail 1*t* where it is connected to the anchor block 70. The hook is oriented to face downstream so that the hook can catch on the orifice of the impact head to help prevent the FTE rail 1 becoming detached from the impact head. The aforementioned orientation of the hook also enables the hook to prevent backward (i.e. upstream) movement of the impact head leading to disconnection from the FTE rail 1.

Figure 18:
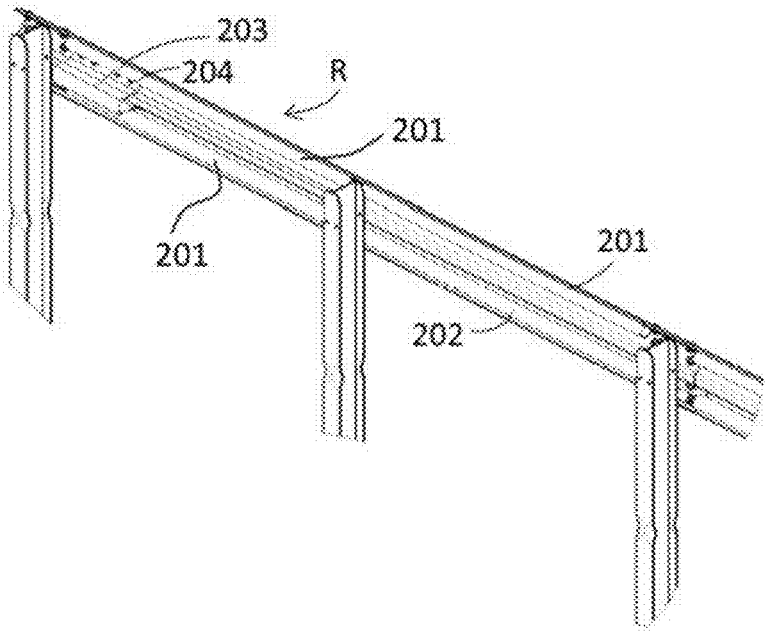
FIG. 18 shows a close perspective view of a retarding section as shown in FIG. 1.

The TES 1000 has a retarding section on one or more rails of at a downstream end of the TES in the region depicted by double headed arrow R in FIG. 1 and by arrow R in FIG. 18.

The retarding section R includes projections in the form of upper and lower tubes in the form of metal pipes 201, 202 which also need to be plastically deformed by the moving energy component, in order for the moving energy component 10, to continue traveling along the rails to which the pipes 201 and 202 are attached. The pipes 201, 202 are positioned in the troughs of the rails as shown and bracketed bolted (not shown) thereto. Preferably, the bolts are the same as used in the joining locations of the primary rail.

The retarding section R also has a stop in the form of a steel flanged u-shaped plate 203 which is securely bolted with ten bolts 204 to the downstream end of the rails where pipes 201,202 terminate. In the embodiment shown in FIGS. 1 and 2 and 18 the stop 203 is located 16 m downstream of the impact head 100.

Summary of TES In Use

When a vehicle has a head on impact with the TES it will strike the upstand of the impact head. The force of the impact will cause the impact head to move forward.

In use after a head on impact the moving component comprising the impact head and associated curved beam(s) and post detacher element travel together as a unit along the FTE rails 1,2 and STE rails 20 of the system to plastically deform the downstream rails of the system—with twists and curves—so as to absorb energy from the impact and help bring the vehicle to a controlled stop.

In the event of a lateral impact this causes rotation of the anchor hitch relative to the anchor plate which have respective convex and concave contact surfaces and the depending on the degree of rotation may cause the anchor hitch to become pulled off the anchor plate via the force of the tensioned rails.

In the event of a reverse impact this causes a compression force to be experienced by the anchor hitch via the impact head and/or FTE rails moving towards the anchor post which releases the anchor hitch from engagement with the anchor plate.

When a vehicle impacts the TES it firstly moves the impact head assembly along the FTE rail, forcing the FTE rail into the axial box and requiring the FTE and then the STE to plastically deform from the suspended height to the height of the axial box and then further plastically deform as it passes through the axial box. All three components (moving of the head, plastic deformation from a height and plastic deformation in the box) are separately controllable in the invention. Furthermore, the invention enables uncoupling of all three to allow their energy dissipations to act together or separately. This may be required if the user wants the energy dissipated by the system to start slowly and build up with movement, or if they are looking to have a staged breaking force.

For example, if the user is wishing for a smooth energy absorption without an initial force spike, it is favorable to decouple the inertia force generated from the need to accelerate the impact head forward from the plastic deformation induced in the rail. This can be achieved by using a FTE section which has an extended horizontal section parallel to the ground on the downstream side of the axial box opening. In this configuration, the head is required to move a distance before the upward sloping component of the FTE rail is impacted and plastic deform occurs. Equally, the profile of the FTE is constricted for a distance downstream of the axial box, limited energy will be absorbed by the axial box as the constricted rail passes through it. Thereby, by controlling the shape and profile of the FTE we can control the force-displacement profile of the system when impacted by an errant vehicle.

DISCUSSION OF THE INVENTION INLCUDING A NUMBER OF NON-LIMITING EXAMPLES OF ENVISAGED ALTERNATE WAYS TO IMPLEMENT THE INVENTION

The terminal end section of the present invention includes a number of different aspects as herein further described to further exemplify the present invention and principles thereof.

Stationary Component

The stationary component of the present invention comprises standard terminal end (STE) rails and formed terminal end (FTE) rails located at an upstream end of the STE rails.

The STE rails of the present invention may include but should not be limited to W-beam and Thrie beam rails. Generally, the type of STE rail used may match the type of rail being used for the road safety rail system. However, this should not be seen as limiting.

Typically, the STE rails may be substantially 4 m in length and such rails may generally be supported on posts spaced 2 m apart. The spacing of the posts being determined at least in part by the length of the rail to be supported. However, this should not be seen as limiting.

The STE rails may be connected to one another in a conventional manner using bolts.

The FTE rail(s)s may generally be the same kind of rails as is used for the STE rails. Thus, the FTE rails may be W-beam or Thrie beam rails.

The FTE rail(s) may be connected at a downstream end thereof to the upstream end of the STE rails.

A portion of the FTE rail(s) may have a twist where an FTE rail transitions from a primarily vertical orientation to a primarily horizontal orientation, whilst maintaining a horizontal axis at substantially the same set height Y above ground level. The FTE rail is now wider than deep.

Preferably the FTE rail is twisted to so that the edges of rail face downwards. For example, where the FTE rail is a W-beam or Thrie beam the outer edges of the W-beam or Thrie beam face downward. An advantage of this orientation is that it presents less of a hazard to road users as the sharp outer edges are facing downwards.

The twist in some embodiments may preferably involve an anticlockwise 180-degree rotation of FTE rail around a central axis. However, it will be appreciated that the twist can also alternately be formed with a 180-degree clockwise rotation of the FTE rail about a central axis.

The FTE rail(s) may then be bent following the twist so that the horizontal orientation of the FTE rail(s) undergoes a first curve downwards towards the ground and may then be curved upwards to become substantially parallel to the ground. This forms a substantially S curve in the FTE rail(S) where the FTE rail(s) starts at the height of the STE rails above the ground surface and ends with the FTE rails at or near the ground surface and substantially parallel thereto.

In some embodiments, it may be possible to combine a twist and a downward curve into a rail using a compound curve or a series of compound curves.

Throughout the twisting and curving process the cross-sectional dimensions of the FTE rails may be maintained. However, it is possible to alter the dimensions and geometric shape of the FTE ails by removing material from the rail with slots, cuts or the like.

The FTE rail(s) may preferably be formed from at least two rails with one rail being formed to have the aforementioned twist and a second rail to have the aforementioned curves.

In preferred embodiments, the section of the FTE rail(s) that is at or near ground level may have a reduced cross-section. This section forming the upstream terminus of the FTE rail(s). This reduction in cross-section may be achieved in a number of ways. Preferably, the FTE rail in this section may be concertinaed. Alternately, the upstream terminus of the FTE rail may have material removed therefrom. In some further preferred embodiments, the upstream terminus of the FTE rail may have material removed before being concertinaed.

Preferably, the terminus may have the middle section of the beam or one or more portions thereof removed therefrom.

The upstream terminus of FTE rail may pass through an orifice in impact head before the FTE rail may be connected directly or indirectly to a releasable connection point.

In one preferred embodiment, the terminus of the FTE rail may be connected to the releasable connection point indirectly by way of an anchor block adjustably attached to an anchor hitch—which releasably connects to a connection point on a ground anchor post—in a manner to enable axial length to be adjusted. Details of this releasable connection will be discussed further below.

In another embodiment, the terminus of the FTE rail may itself be directly connected to the releasable connection point. By way of illustrative example only, the terminus of the FTE rail may include a hook like portion on the end thereof which catch a portion of the releasable connection point.

Moving Energy Absorbing Component

An impact head including a base and upright projection, the base comprising at least one axial orifice extending from a downstream end to an upstream end, through which, in use, a terminus of a distal FTE rail is passed before being connected to the releasable connection point.

Preferably, the impact head may have a base having a convex curved bottom surface when viewed side on. This helps the impact head travel along the FTE and STE rails after a head on impact from an errant vehicle. The applicant has found that the convexly curved bottom surface facilitates travel along the ground after a head on impact occurs as it minimizes the potential for snagging to occur. The convexly curved bottom surface also limits the potential for debris to enter the axial orifice. In addition, the convexly curved bottom surface may assist the rail entering the axial orifice of the impact head.

Preferably, the impact head may have a base which has a wider downstream end and a narrower upstream end.

The Applicant has found when the impact head is hit from a lateral impact it may preferable for the impact head to tip sideways which makes the base less stable for lateral impacts in this direction. Equally when the impact head receives a reverse impact it is preferable for the impact head to tip, rock or rotate sideways.

Preferably, the impact head includes an axial orifice which may be constricted in dimension at some point along the length thereof, so in use a rail passing therethrough is forced to undergo a plastic deformation to decrease in size, prior to leaving the axial orifice at a rail exit point.

Preferably, the dimensions of the rail exit point may be smaller than the dimensions of the rail entry point.

The axial orifice of the impact head may have a cross-sectional profile which is tapered in at least the horizontal plane.

In some further embodiments, the axial orifice of the impact head may have a cross-sectional profile which is tapered in the vertical plane. In some even further embodiments the axial orifice may have a cross-sectional profile which is tapered in both the horizontal and vertical planes.

In general, the aforementioned axial orifice tapering may be such that the orifice has a larger dimensioned downstream opening than that of upstream opening. By this means the axial orifice is able to function as a constricting box which in use may deform the rail when the axial orifice is tapered in the horizontal plane as aforementioned with the upstream end of the orifice having a reduced width relative to the downstream end.

However, the above should not be seen as limiting as the tapering may not run all the way through the axial orifice from the entry point to the exit point. A constriction may be positioned at any point in the axial orifice away from the entry point.

In some embodiments, the axial orifice may in addition to concertinaing the rail reform the configuration of the rail profile prior to exiting the orifice to back to the rail profile immediately prior to entering the constriction box (i.e. un-concertina the rail). It can be seen that the axial orifice functions as a constricting box which plastically deforms the rail in at least once during the rails travel through the box (i.e. axial orifice). Thus, it is possible in some embodiments for the rail after being plastically deformed to subsequently—within the axial orifice—be plastically reformed to return to substantially the original shape of the rail, in order to dissipate energy.

As will be appreciated from the above discussion the dimensioning of the axial orifice in the impact head may be used to increase frictional force encountered by rails passing therethrough as the impact heads moves there along after a head on impact. Accordingly, by this means the impact head can dissipate the energy of a collision via the plastic deformation of the rail traveling through the axial orifice of the impact head. Additionally, for STE rail(s) to pass through the axial orifice of the impact head they must undergo the twist and bending (i.e. plastic deformation) of the FTE rails mentioned above which also dissipates further energy and helps bring a vehicle having a head on impact to a controlled stop.

Preferably, the axial orifice of the impact head may have curved surfaces at the entry and exit points thereof to facilitate free flowing travel through the orifice and to prevent snagging or catching as it enters/exits.

The impact head may have the exit point of the axial orifice may be angled slightly upwardly relative to the horizontal. The applicant has found that having an upward angle at the exit point will cause the impact head to tip slightly forward which will lift the post detacher and at least one beam (which is preferably although not limited to, two curved W-beam rails) upwards—due to the tension in the rails.

Preferably, the axial orifice may be downwardly curved from the downstream entry point to upstream exit point.

The upright on the impact head presents the impact surface for an errant vehicle having a head on impact or lateral impact at or near the releasable connection point which holds the rails of the TES under tension. The exact height of the impact will be determined by the geometry of the vehicle, but will nevertheless occur above the height of the axial orifice.

With a head on impact the force will cause the impact head to move along the FTE rails in a downstream direction towards the STE rails. As the impact head moves forward this pulls the rails into the axial orifice which is configured to act as a constricting box. This dissipates energy via the plastic deformation of the rail and helps bring the vehicle to a controlled stop. Additionally, for downstream rails or portions thereof to feed into the axial orifice the rail or portion thereof must first undergo the same plastic deformation as the FTE rail(s) namely a twist and then a S-bend curvature. This further plastic deformation of the rails to get into the axial orifice absorbs additional energy and further helps bring the vehicle to a controlled stop.

Preferably, the upstand may have a cross-sectional profile which resembles an I-beam, or U-beam, or other cross-sectional profile which has structural strength and can be configured to connect to the base, in a manner which will resist the force of an impact by an errant vehicle, so as to enable the impact head to stay in contact with the vehicle and travel along the rails after an impact.

The upright on the impact head may be connected via at least one beam to a post detacher element located downstream of said impact head a pre-determined distance therefrom.

The at least one beam connecting the upright to a post detacher element may come in a variety of different forms.

Preferably, the at least one beam has at least one bend therein. In some embodiments, the bend may be in the form of an angle. Preferably the angle may be substantially 170 degrees and greater than substantially 120 degrees.

In a preferred embodiment, the at least one beam may be curved. It is envisaged the curvature of a one beam embodiment may be similar to the two-beam embodiment shown in the FIG. 2. In a one-beam embodiment, the beam may be located above the FTE rail(s) and have its longitudinal axis aligned with the longitudinal axis of the FTE rail(s).

In preferred embodiments, there may be two curved beams which are located on either side of the impact head. Having two curved beams as aforesaid can help stabilise the rails as the impact head travels there along and the STE rails are forced to undergo plastic deformations (i.e. twisting and bending before being constricted). In addition, having two curved beams connecting the upright to the post detacher can also provide lateral stability to the impact head when subjected to lateral impacts or reverse impacts, providing a righting moment to keep the impact head upright. The two curved beams can also provide lateral resistance to the TES itself helping to redirect the vehicle in lateral impacts along the face of the barrier.

Preferably, the at least one beam may be a W-beam or Thrie beam although this should not be seen as limiting as other sorts of beam having the necessary strength and stiffness are envisaged.

The beam(s) connecting the upright to the post detacher may provide a righting force to the impact head which prevents the impact head rotating back on the curved surface of the base when a head on impact is received due to the applied moment being above the height of the axial orifice. Instead the beam(s) can help to transfer the applied moment into a direct force that causes the impact head to move in the direction of the rails and not rotate forward.

The predetermined distance of the upright to the post detacher element may equate to the length of the at least one beam which connects the upstand to the post detacher element. It should be appreciated that the at least one beam may be made of one or more beam sections which are joined together to provide the desired length and/or required curvature.

The applicant has found that the shorter this predetermined distance (i.e. length of the beam) the more force that can be dissipated (i.e. absorbed) by the moving head component as the impact head travels along the rails. As the rail must work harder to undergo the plastic deformations (i.e. twisting and bending before being constricted).

In some embodiments, at least one FTE rail may have material removed therefrom to assist with deformation of the FTE prior to entry into the impact head to assist. The removal of material from the FTE rail may be used to alter the shape of the FTE to overcome the inertia of the stationary impact head so the impact head can start moving first before any plastic deformation of rail is needed.

Furthermore, the shortened predetermined distance increases the downward force imposed on the post detacher. Conversely, the longer the predetermined distance the lesser the downward force imposed on the post detacher.

Preferably, the predetermined distance between the upright and the post detacher element may be substantially 2 m-5 m. In a preferred embodiment, the predetermined distance between the upright and the post detacher may be substantially 4 m.

The impact head may also include a brace element.

The brace element may have a variety of different cross-sectional profiles.

In one preferred embodiment, the brace element may be made from an I-beam.

In another embodiment, the brace element may be made from RHS steel or CHS steel.

Preferably, the brace element may be adapted to connect to the upstand at one end thereof and to the at least one beam at the other end. The adaptation may take a variety of different forms which may include apertures for bolting to the upstand and at least one beam which have corresponding apertures.

In one preferred embodiment, the brace element may have a cross bar at the top thereof and have substantially T shape. It will be appreciated other shapes may be used for the brace element without departing from the scope of the present invention.

The non-orthogonal angle may generally correspond to the slope on the FTE rail which transitions from the STE rail height above ground down to a height at or near ground level.

Preferably the angle may be substantially 35 degrees.

Posts

The posts may be connected to the TES in a manner which enables the post detacher to disconnect the posts from the rails and bend the post over sideways.

To help achieve this disconnection the posts may be connected in a variety of ways to facilitate this objective. For example, the posts can be connected to the rails using small diameter bolts which fracture on shear loading, the use of deformable washers, or slots in the side of the posts rather than a hole which enable the bolts to slide out of the post when impacted by the post detacher. However, this list should not be seen as limiting.

It is envisaged the cross-sectional profile of the posts of the present invention can vary.

Preferably, the posts of the present invention used in the terminal end section (TES) may be I-beams which have be adapted to have a reduced cross-sectional strength at predetermined locations. This helps enable the posts to be easily deformed in this location rather than shearing upon receiving an impact force in a predetermined direction. However, as mentioned other post cross-sectional profiles may be employed provided they can be adapted to fold and not tear.

Preferably, the posts be provided with dimples on the upstream edge of the flanges of the I-beam at a height on the post, which in use, corresponds to being at, or near, ground level. The applicant has found dimpling to be effective way to enable the post to fold over and become substantially parallel to the ground or at least angled away from the impacting vehicle should it travel along the barrier.

In some other embodiments, the posts may have notches cut or otherwise formed in the upstream edge of the flanges of the I-beam at a height on the post which, in use, substantially corresponds to being at, or near, ground level.

Preferably, the top of the posts is curved. This helps prevent the corner of the top of the post snagging on the underside of a vehicle when the posts are deformed laterally.

Releasable Connection Point

The releasable connection point comprises an anchor hitch and an anchor protrusion which may directly or indirectly couple the FTE rail to the ground anchor.

The releasable connection point couples the FTE rails to a ground anchor.

The ground anchor may generally be in the form of a ground anchor post.

However, this should not be seen as limiting, as in some embodiments the ground anchor may be in the form of a concrete block or other element(s) secured into the ground or onto a ground surface. For example, only where there is a concrete ground surface the ground anchor may be a metal bar or such like which is bolted into the concrete.

The ground anchor post may come in a variety of different forms as would be readily apparent to a person skilled in the art.

Preferably, the ground anchor may be in the form of a post may be made from an I-beam although other cross-sectional profiles are envisaged.

In other embodiments, the ground anchor may be in the form of a concrete block.

In one preferred embodiment, the ground anchor post may have a soil plate thereon.

The anchor-protrusion may come in a variety of different configurations without departing from the scope of the present invention.

In one preferred embodiment, the anchor protrusion may be in the form of an anchor plate. The anchor plate may have a substantially rectangular profile when viewed in plan but for an upstream edge which includes a concave curve therein.

In an alternate embodiment, the anchor protrusion may have a substantially rectangular profile when viewed in plan but for an upstream bottom edge which includes a concave curve therein (when view in plan) and wherein the anchor plate has leading (i.e. upstream) edge diagonally oriented in a downstream direction depending from the top surface of said plate—when viewed in cross-section).

The ground anchor hitch may come in a variety of different forms without departing from the scope of the present invention.

In general, the anchor hitch may include a recess thereon which in use can receive and capture the anchor protrusion.

In preferred embodiments, the anchor hitch includes a recess having no side walls into which the anchor protrusion may be received and retained whilst the rails remain under tension and from which the anchor protrusion may be released upon a vehicle having a lateral impact and/or reverse impact(s) and the forces imposed on the anchor hitch changing in magnitude and/or direction.

In one preferred embodiment, the anchor hitch may include a body portion and a bearing edge which extends down therefrom, the distal end of the bearing edge including a catch plate thereon configured to form a catch zone. Preferably, this arrangement of an anchor hitch forms a hook like structure with the anchor plate being captured in the catch zone.

In an alternate embodiment, the anchor hitch may include a body portion having a stepped downstream bottom leading edge (the step), with a top surface of the step being horizontal and in line with any tension force the hitch will in use experience; wherein a downwardly depending surface of the step is diagonally oriented in an upstream direction with respect to the top surface of the stepped portion.

The concave curve on the downstream edge of the anchor plate helps facilitate rotational movement with the concave curve on the bearing edge of the anchor hitch—and catch plate in embodiments which include this latter optional feature. Said relative rotation leading to release of the connection upon lateral impacts.

Retarding Section

A retarding section on more or more rails of at a downstream end of the TES wherein the retarding section includes at least one projection extending, or series of projections positioned, along the length of the non-trafficable side of a rail, wherein the portion of the downstream rail where the projection(s) terminate includes a stop thereon.

The at least one projection may be in the form of one or more tubes which need to be plastically deformed by the impact head or post detacher, in order for the moving energy absorbing component, to continue traveling down the length of rails after an impact.

The series of projections may vary without departing from the scope of the present invention.

In one preferred embodiment, the series of projections may be in the form of plurality of deformations punched into the rail along the length thereof which project out from the non-trafficable side of the rail.

Alternately the series of projections may be a series of bolts positioned along the flutes of the corrugated beam so as to impact the edge of the axial orifice in the impact head. The impact head being required to shear the bolts to continue traveling down the length of rails after an impact.

The stop may have a number of configurations and may be made of a number of materials provided the stop is capable of preventing movement of the moving energy absorbing component and/or impact head along the rails at a point downstream of said stop.

In one preferred embodiment, the stop may be in the form of a length of flanged u-section steel which is bolted to the non-trafficable side of a downstream rail of the TES.

In an alternate embodiment, the stop could be one or two or more standard posts positioned side by side the post detacher needs to deform/break in order to continue travel down the rails.

Further energy remaining from the vehicle impact may be dissipated once the post detacher impacts the stop and ceases traveling along the rails by the curved beams first bowing outwards due to movement of the impact head and then the beams becoming crushed if necessary to bring the impact head to a stop.

Advantages

Advantages of the present invention can include, but should not be limited to, one or more of the following:

- Minimizes the risk of components of the terminal end section snagging or otherwise interfering with an errant vehicle which crashes into the barrier at or near a terminal end thereof;
- Usefully absorbing the energy of collisions at the terminal end in a controlled and repeatable manner, in particular for head on impacts at a terminal end of a barrier so as to bring a vehicle to a controlled stop;

The ability to have a restrained release of the impact head from the ground anchor in certain circumstances;

The ability to retain the impact head in a connected state to the rails even after the rail tension has been released;

Maintaining alignment of impact head during travel along the rails;

The ability to contain or redirect an errant vehicle, or allow an errant vehicle to pass over a portion of the terminal end of the rail system;

Providing a rail element to ground anchor connection which has sufficient strength to—when a rail is impact by an errant vehicle somewhere along the length of the rail system—resist the high-tension forces that are generated by capturing or redirecting the errant vehicle;

Providing a rail to ground anchor connection which has sufficient strength to—when a vehicle impacts the terminal end in a head on impact—resist the high-tension forces that are generated;

Providing a rail to ground anchor connection which upon receiving a lateral impact at or near the terminal end placing the connection under high tension and high shear forces the connection between the rail and ground anchor is released;

Providing a rail to ground anchor connection which upon receiving a reverse impact the connection is placed under a compressive force and releases;

Providing a rail to ground anchor connection which

Providing a road safety terminal end where the impact head is retained in connection with the rail in a reverse impact collision, to help prevent the impact head which can weigh up to 100 kg from becoming a hazard if expelled from the system at high velocity;

Adjustability of the energy absorbed by altering the distance between the post detacher and the impact head. As a shorter the distance between the post detacher and the impact head the more energy that can be dissipated—e.g. by using shorter curved beam(s) to connect the impact head to the post detacher;

A stop to prevent to limit the distance the moving component can travel along the rails;

Absorption of further energy if required by bending and then crushing the curved beams connecting the post detacher to the impact head when the post detacher hits the stop;

The system does not eject debris;

Posts that fold over so as to not create a hazard;

Posts with a rounded top to not create sharp edges which can create a hazard or snag the underside of a vehicle.

The invention may also be said broadly to consist in the parts, elements and features referred to or indicated in the specification of the application, individually or collectively, in any or all combinations of two or more of said parts, elements or features.

Aspects of the present invention have been described by way of example only and it should be appreciated that modifications and additions may be made thereto without departing from the scope thereof as defined in the appended claims.

What is claimed is:

1. A moving energy absorbing component comprising:

at least one formed terminal end (FTE) rail, wherein the at least one FTE rail includes a twist from a primarily vertical orientation to a primarily horizontal orientation, whilst maintaining a horizontal axis at the same set height above ground level; and wherein the at least one FTE rail bends down from a set horizontal axis height above ground level (Y) to a horizontal axis height being at, or near ground level;

an impact head including a base and upright projection, the base comprising an axial orifice extending from a downstream entry point to an upstream exit point, through which an upstream terminus of an FTE rail is passed;

wherein a top portion of the upright projection on the impact head is connected via at least one beam to a post detacher element located downstream of said impact head a pre-determined distance therefrom.

2. A moving energy absorbing component as claimed in claim 1 wherein the moving energy absorbing component further includes a brace element which diagonally extends at a predetermined non-orthogonal angle from the impact head to a point adjacent the top of the entry point of the axial orifice to the at least one beam.

3. A moving energy absorbing component as claimed in claim 2 wherein the brace extends from the base of the impact head.

* * * * *